US011414943B2

(12) United States Patent
Nguyen et al.

(10) Patent No.: US 11,414,943 B2
(45) Date of Patent: Aug. 16, 2022

(54) ON-DEMAND HYDROSTATIC/HYDRAULIC TRIGGER SYSTEM

(71) Applicants: Tuan Nguyen, Pearland, TX (US); Gregory Hern, Porter, TX (US); Alexander Woodruff, Houston, TX (US); Chad Yates, Houston, TX (US); Farhat Shaikh, Houston, TX (US)

(72) Inventors: Tuan Nguyen, Pearland, TX (US); Gregory Hern, Porter, TX (US); Alexander Woodruff, Houston, TX (US); Chad Yates, Houston, TX (US); Farhat Shaikh, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/829,068

(22) Filed: Mar. 25, 2020

(65) Prior Publication Data

US 2021/0301614 A1 Sep. 30, 2021

(51) Int. Cl.
*E21B 23/08* (2006.01)
*E21B 34/14* (2006.01)

(52) U.S. Cl.
CPC ..... *E21B 23/08* (2013.01); *E21B 34/14* (2013.01); *E21B 2200/06* (2020.05)

(58) Field of Classification Search
CPC ..... E21B 23/08; E21B 34/14; E21B 2200/06
See application file for complete search history.

(56) References Cited

U.S. PATENT DOCUMENTS

| | | | | |
|---|---|---|---|---|
| 3,115,933 | A | 12/1963 | Haeber | |
| 3,223,164 | A | 12/1965 | Otteman | |
| 3,409,096 | A | 11/1968 | Brown | |
| 4,216,835 | A * | 8/1980 | Nelson | E02D 27/52 166/338 |
| 5,002,131 | A | 3/1991 | Cromar et al. | |
| 5,109,924 | A | 5/1992 | Juergens et al. | |
| 5,431,220 | A | 7/1995 | Lennon et al. | |
| 5,474,126 | A | 12/1995 | Lynde et al. | |
| 5,592,991 | A | 1/1997 | Lembcke et al. | |

(Continued)

FOREIGN PATENT DOCUMENTS

| | | | |
|---|---|---|---|
| EP | 0916014 | A1 | 5/1999 |
| WO | 02097234 | A1 | 12/2002 |

(Continued)

OTHER PUBLICATIONS

International Search Report and Written Opinion for International Application No. PCT/US2021/023602; International Filing Date Mar. 23, 2021; dated Jul. 1, 2021 (pp. 1-7).

(Continued)

*Primary Examiner* — Dany E Akakpo
(74) *Attorney, Agent, or Firm* — Cantor Colburn LLP

(57) ABSTRACT

A downhole component including a member having an outer surface, a constrained element configured to move relative to the member between a first position and a second position, and an on-demand hydrostatic/hydraulic trigger system including a constraining element operable to selectively release the constrained element. The on-demand hydrostatic/hydraulic trigger system includes a piston cylinder.

10 Claims, 6 Drawing Sheets

(56) References Cited

U.S. PATENT DOCUMENTS

| | | | | |
|---|---|---|---|---|
| 5,699,858 | A | 12/1997 | McAnally | |
| 5,709,265 | A | 1/1998 | Haugen et al. | |
| 5,718,291 | A | 2/1998 | Lorgen et al. | |
| 5,803,176 | A | 9/1998 | Blizzard, Jr. et al. | |
| 5,878,818 | A | 3/1999 | Hebert et al. | |
| 6,032,740 | A | 3/2000 | Schnitker et al. | |
| 6,311,792 | B1 | 11/2001 | Scott et al. | |
| 6,464,002 | B1 | 10/2002 | Hart et al. | |
| 6,550,540 | B2 | 4/2003 | Trent | |
| 6,695,056 | B2 | 2/2004 | Haugen | |
| 7,878,253 | B2 | 2/2011 | Stowe et al. | |
| 8,327,944 | B2 | 12/2012 | King et al. | |
| 8,453,729 | B2 | 6/2013 | Harris et al. | |
| 8,469,096 | B2 | 6/2013 | McGarian | |
| 8,967,279 | B2 | 3/2015 | Hered et al. | |
| 9,140,083 | B2 | 9/2015 | Delgado et al. | |
| 9,267,355 | B2 | 2/2016 | Lumbye | |
| 10,227,823 | B2 | 3/2019 | Hern et al. | |
| 10,563,471 | B2 | 2/2020 | Georgsen et al. | |
| 10,724,319 | B2 | 7/2020 | Hulsewe | |
| 2002/0170713 | A1 | 11/2002 | Haugen et al. | |
| 2004/0007390 | A1 | 1/2004 | Zupanick | |
| 2004/0238171 | A1 | 12/2004 | McGarian et al. | |
| 2005/0039905 | A1 | 2/2005 | Hart et al. | |
| 2006/0207771 | A1 | 9/2006 | Rios et al. | |
| 2007/0044954 | A1 | 3/2007 | Dewey | |
| 2009/0266544 | A1 | 10/2009 | Redlinger et al. | |
| 2009/0266556 | A1* | 10/2009 | Swenson | E21B 23/02 166/373 |
| 2010/0224372 | A1 | 9/2010 | Stowe et al. | |
| 2010/0270031 | A1 | 10/2010 | Patel | |
| 2010/0307736 | A1 | 12/2010 | Hearn et al. | |
| 2010/0319997 | A1 | 12/2010 | King et al. | |
| 2012/0255785 | A1 | 10/2012 | Gregurek et al. | |
| 2012/0261193 | A1 | 10/2012 | Swadi et al. | |
| 2013/0020084 | A1 | 1/2013 | Goodson | |
| 2013/0199791 | A1 | 8/2013 | Hill, Jr. et al. | |
| 2013/0269928 | A1 | 10/2013 | Zhou | |
| 2013/0299160 | A1 | 11/2013 | Lott | |
| 2013/0341048 | A1 | 12/2013 | Delgado et al. | |
| 2014/0020904 | A1 | 1/2014 | Hill, Jr. et al. | |
| 2014/0318780 | A1* | 10/2014 | Howard | E21B 34/06 166/285 |
| 2015/0152703 | A1 | 6/2015 | Haun | |
| 2016/0238055 | A1 | 8/2016 | Donovan | |
| 2016/0348456 | A1 | 12/2016 | Laplante et al. | |
| 2017/0030168 | A1* | 2/2017 | Akkerman | E21B 34/063 |
| 2017/0306711 | A1 | 10/2017 | Hern et al. | |
| 2017/0328177 | A1 | 11/2017 | Sheehan et al. | |
| 2018/0209232 | A1 | 7/2018 | Hulsewe | |
| 2018/0209233 | A1 | 7/2018 | Hulsewe | |
| 2018/0320480 | A1 | 11/2018 | Jelly et al. | |
| 2018/0334872 | A1 | 11/2018 | Vuyk | |
| 2019/0003264 | A1 | 1/2019 | Swadi et al. | |
| 2019/0106940 | A1 | 4/2019 | Korf et al. | |
| 2019/0120005 | A1 | 4/2019 | Hulsewe | |
| 2019/0330944 | A1 | 10/2019 | Crabb et al. | |
| 2020/0011134 | A1 | 1/2020 | Nevlud et al. | |
| 2020/0018131 | A1 | 1/2020 | Telfer et al. | |
| 2020/0088001 | A1 | 3/2020 | Morland | |
| 2021/0317705 | A1 | 10/2021 | Gregurek et al. | |
| 2021/0363842 | A1 | 11/2021 | Nguyen et al. | |

FOREIGN PATENT DOCUMENTS

| | | | |
|---|---|---|---|
| WO | 2006070204 | A2 | 7/2006 |
| WO | 2016209686 | A1 | 12/2016 |

OTHER PUBLICATIONS

International Search Report and Written Opinion for International Application No. PCT/US2021/023603; International Filing Date Mar. 23, 2021; dated Jul. 1, 2021 (pp. 1-7).

International Search Report and Written Opinion for International Application No. PCT/US2021/023604; International Filing Date Mar. 23, 2021; dated Jul. 1, 2021 (pp. 1-9).

International Search Report and Written Opinion for International Application No. PCT/US2021/023605; International Filing Date Mar. 23, 2021; dated Jul. 1, 2021 (pp. 1-8).

International Search Report and Written Opinion for International Application No. PCT/US2021/023606; International Filing Date Mar. 23, 2021; dated Jul. 1, 2021 (pp. 1-7).

International Search Report and Written Opinion for International Application No. PCT/US2021/023609; International Filing Date Mar. 23, 2021; dated Jul. 5, 2021 (pp. 1-10).

"Timken introduces two high performance alloy steel grades" Offshore Magazine, Offshore Staff, Nov. 11, 2013 (pp. 1-5).

C95400 Product Spec Sheet; Concast Metal Products, Jul. 27, 2010 (pp. 1-2).

C95510 Product Spec Sheet; Concast Metal Products, Dec. 22, 2010 (pp. 1-2).

Notification of Transmittal of the International Search Report and the Written Opinion of the International Searching Authority, or the Declaration; PCT/US2017/066117; dated Mar. 29, 2018; 13 pages.

Notification of Transmittal of the International Search Report and the Written Opinion of the International Searching Authority, or the Declaration; PCT/US2017/066119; dated Mar. 29, 2018; 10 pages.

* cited by examiner

ON-DEMAND HYDROSTATIC/HYDRAULIC TRIGGER SYSTEM

BACKGROUND

In the resource recovery industry, it is often desirable to shift or release components in a wellbore. The component may represent a sliding sleeve, valve, a screen component, a piston or the like. The component may be used to activate or move another component. Currently, a variety of systems are employed to shift components. Components may be shifted using tools introduced into a tubular, by releasing and pressuring up against a ball dropped into the tubular, or through various hydrostatic and hydraulic systems that rely on fluid pressure to trigger release of the component.

In some cases, hydrostatic and hydraulic systems include fall back systems that reduce the likelihood that too much energy would be input into the component. In addition, hydrostatic and hydraulic systems are dependent on piston and bore sizes. Thus, to reduce an amount of force needed to activate a particular hydrostatic and hydraulic systems a larger piston/bore would be needed. Making a larger piston/bore in a tubular would detract from available area for transporting fluids.

In addition, hydrostatic and hydraulic systems used to trigger the release of a component are often complex devices that must be assembled at a wellhead, require the use of heavy equipment, and are often difficult to assembly and configure. Accordingly, the industry would be open to a readily installable hydrostatic and hydraulic trigger system that is easy to assemble, may be mounted off-site, and which by its design is incapable of overpowering a component during release.

SUMMARY

Disclosed is a downhole component including a member having an outer surface, a constrained element configured to move relative to the member between a first position and a second position, and an on-demand hydrostatic/hydraulic trigger system including a constraining element operable to selectively release the constrained element. The on-demand hydrostatic/hydraulic trigger system includes a piston cylinder.

Also disclosed is a method of selectively releasing a constrained member in a subterranean component disposed in a wellbore including directing fluid pressure onto a constraining element arranged in a cylinder formed in the subterranean component, shifting the constraining element away from the constrained member, and shifting the constrained member from a first position to a second position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
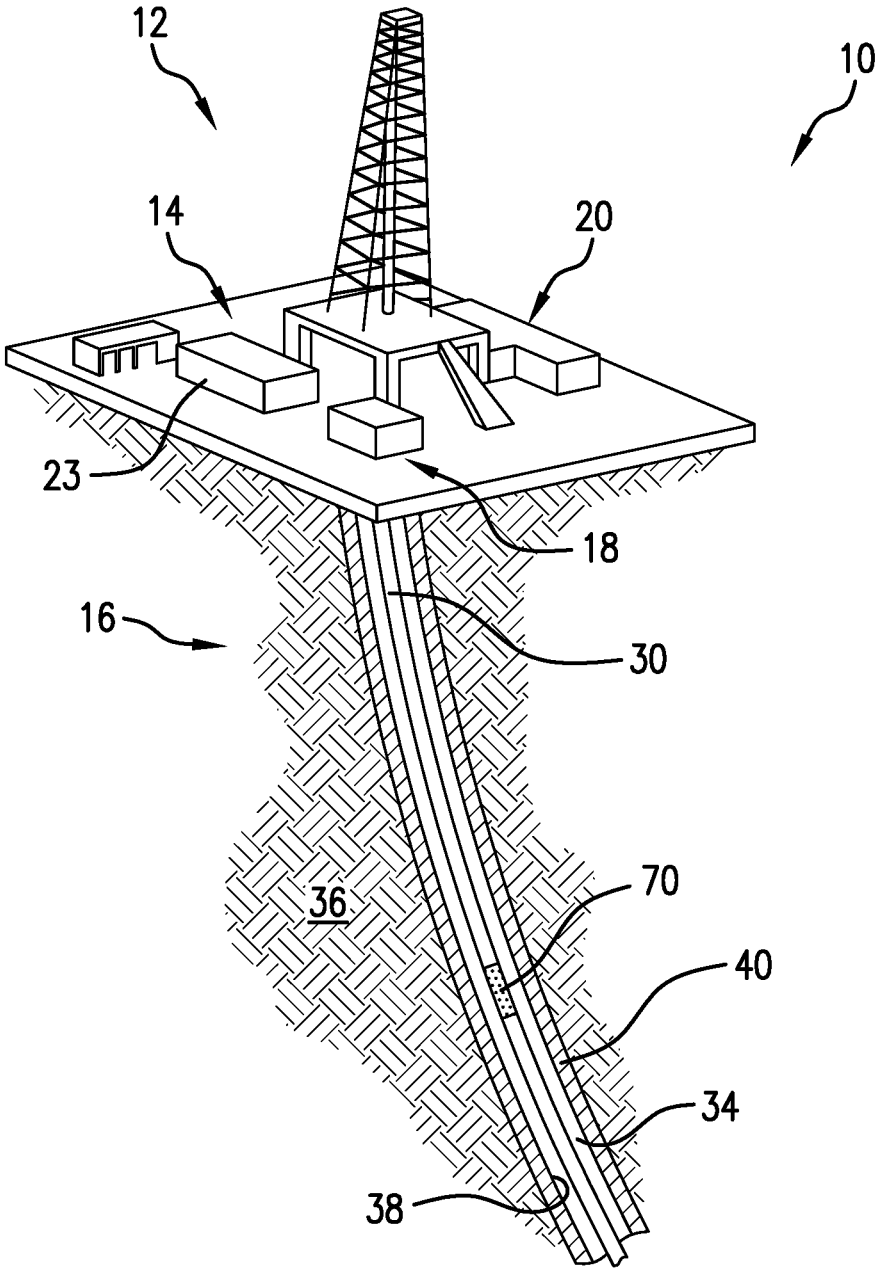
FIG. 1 depicts a resource exploration and recovery system including a component having an on-demand hydrostatic/hydraulic trigger system, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40. Tubular string 30 may support a component 70 that may include, for example, a sliding actuator. The sliding actuator may be employed in a variety of systems including sliding valves and the like.

Figure 2:
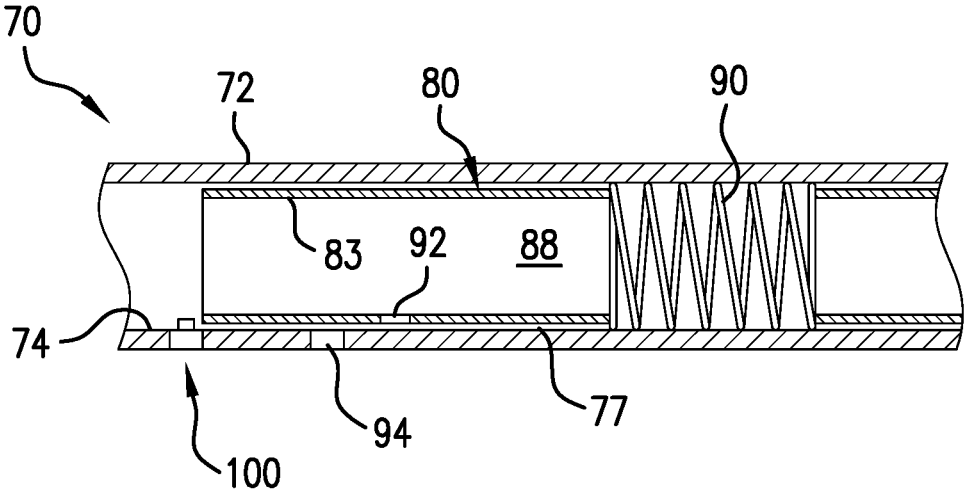
FIG. 2 depicts a cross-sectional side view of the component of FIG. 1.

Referring to FIG. 2, component 70 includes an outer surface 72 and an inner surface 74 that defines an activator passage 77. A constrained member 80 is arranged in activator passage 77. In the present case, constrained member 80 is shown in the form of a sliding sleeve 83 having a central flow bore 88. Sliding sleeve 83 may axially shift along component 70 shift between a first position as shown in FIG. 2 to a second position (not shown). A biasing element 90 may be employed to move sliding sleeve 83 between the first position and the second position. At this point, it should be understood, that once released, various methods may be employed to move constrained member 80, a biasing element such as shown at 90 is but one example.

Figure 5:
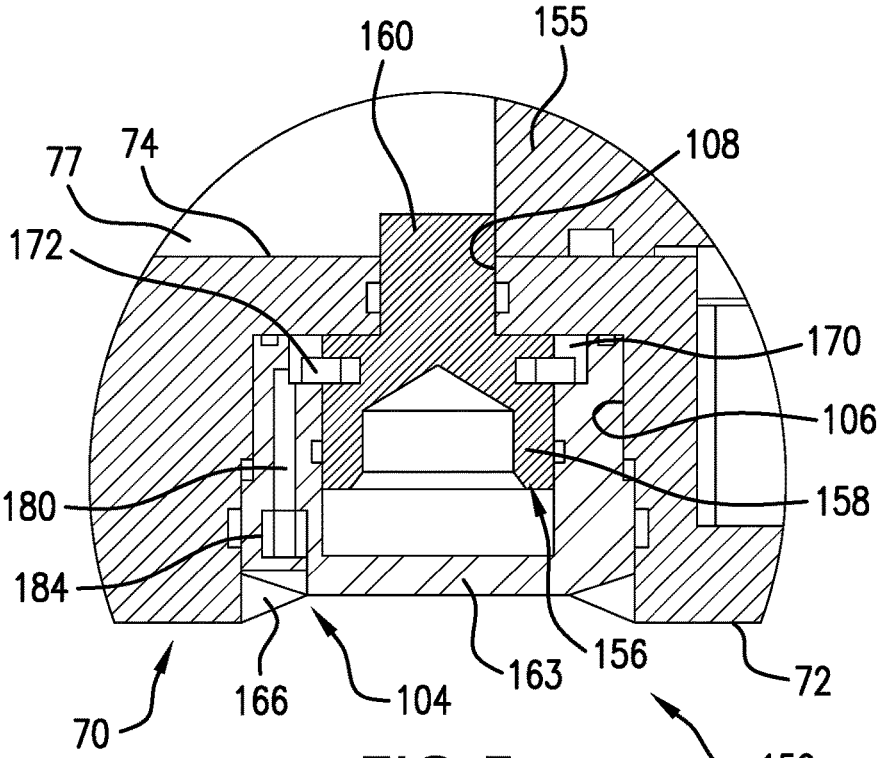
FIG. 5 depicts an on demand hydrostatic/hydraulic trigger system, in accordance with another aspect of an exemplary embodiment.

At this point, it should be understood that constrained member 80 may take on many forms. Constrained member 80 may include central bore as shown or may include a solid cross-section (FIG. 5). Constrained member 80 may act upon another element to bring about a desired outcome or, in the alternative may be released to as to bring about the desired outcome itself. For example, constrained member 80 may include one or more openings 92 that are brought into alignment with one or more openings 94 in component 70. The desired outcome may take on many forms including, but not limited to, opening a fluid pathway; activating a downhole device such as a sensor; triggering a component such as a downhole charge, releasing a whipstock or the like. Constrained member 80 may also take the form of an anchor or slip that is released to engage with and lock to another component.

As will be detailed herein, constrained member 80 is simply released to allow movement in order to bring about the desired outcome. Movement of the constrained member may take on various forms. Movement may be initiated from the surface including pushing, pulling, and rotation; movement may be initiated by a tool; or movement may be initiated by an energy device such as a spring, an amount of trapped gas; or movement may be initiated through mechanical means such as contact with another device or a wellbore surface. Movement may result in axial shifting, radial shifting, and/or rotation.

Upon shifting, one or more openings 92 in sliding sleeve 83 may align with one or more openings 94 in component 70 to establish a passage (not separately labeled) that allows fluid to flow from tubular string 30 into wellbore 34 or, alternatively, from wellbore 34 into tubular string 30. Of course, it should be understood, that sliding sleeve 83 may also be configured to shift and cover a passage in order to block flow. An on-demand hydrostatic/hydraulic trigger system 100 is mounted to component 70 to selectively restrain and release constrained member 80.

Figure 3:
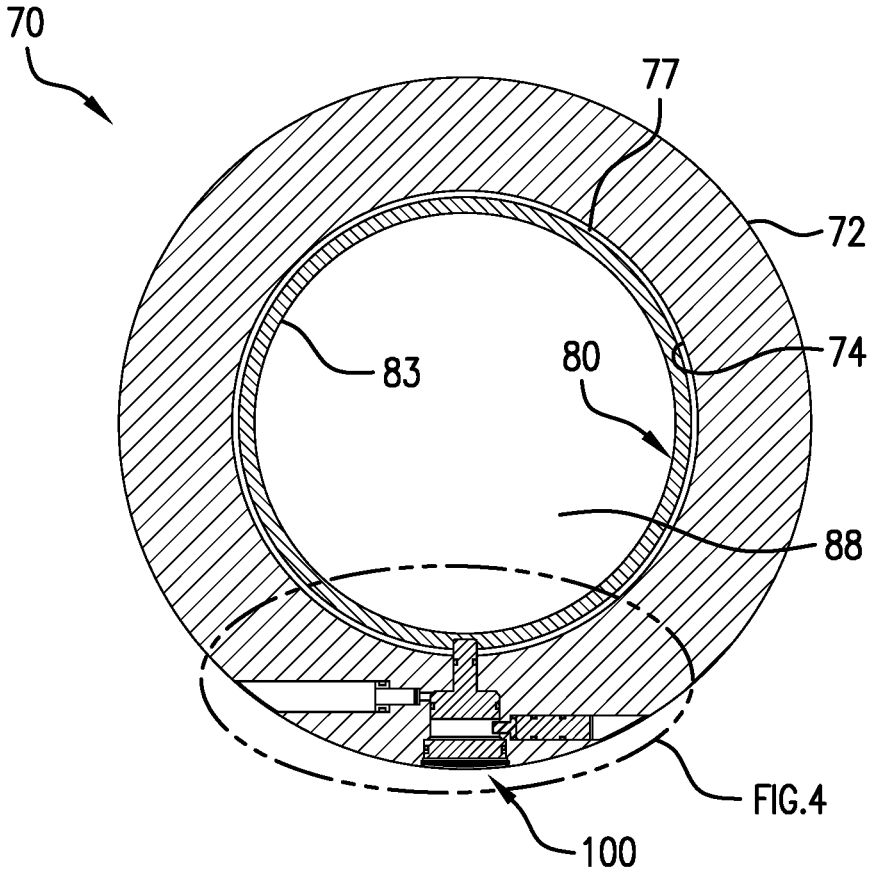
FIG. 3 depicts a cross-sectional axial end view of the component of FIG. 1.
Figure 4:
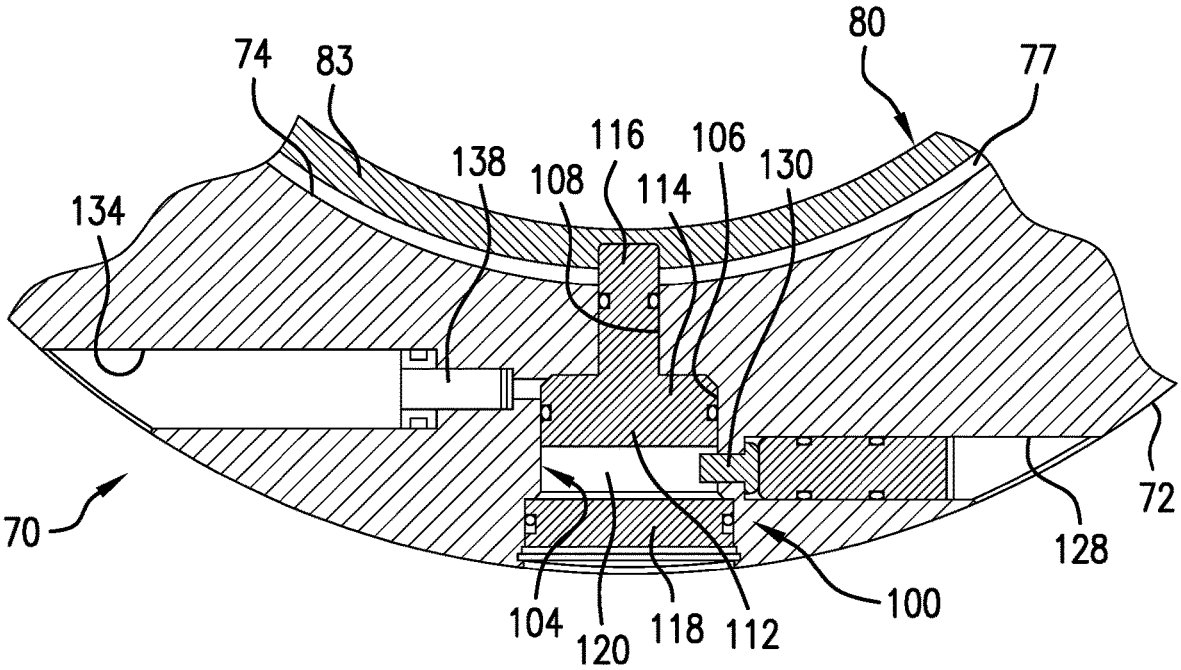
FIG. 4 depicts a detail view of a portion of the component of FIG. 3 illustrating an on demand hydrostatic/hydraulic trigger system, in accordance with an aspect of an exemplary embodiment.

In accordance with an exemplary embodiment illustrated in FIGS. 3 and 4, on demand hydrostatic/hydraulic trigger system 100 includes a piston cylinder 104 formed between outer surface 72 and inner surface 74. Piston cylinder 104 extends radially inwardly from outer surface 72 and into passage 77 and includes a first cylinder portion 106 having a first diameter (not separately labeled) and a second cylinder portion 108 having a second diameter (also not separately labeled) that is smaller than the first diameter.

A piston 112 is arranged in piston cylinder 104. Piston 112 defines a release and includes a first piston portion 106 second piston portion 116 that acts as a constraining element which prevents movement of Constrained member 80. First piston portion 114 includes a first diameter (not separately labeled) that is corresponds to the first diameter of first cylinder portion 106 and second piston portion 116 includes a second diameter (also not separately labeled) that corresponds to the second diameter of second cylinder portion 108. A plug 118 extends through outer surface 72 into piston cylinder 104 trapping an amount of air radially outwardly of piston 112 forming an atmospheric chamber 120.

In an embodiment, a channel 128 extends radially into piston cylinder 104 and connects with first cylinder portion 106. A frangible element 130 is arranged in channel 128. Frangible element 130 selectively prevents piston 112 from shifting radially outwardly relative to passage 77 into piston cylinder 104. A trigger passage 134 extends radially into piston cylinder 104 and connects with second cylinder portion 108. Trigger passage 134 terminates at an interface between first cylinder portion 106 and second cylinder portion 108.

A burst disc 138 is arranged in trigger passage 134. Burst disc 138 selectively fluidically isolates piston cylinder 104 from annular pressure. In an embodiment, pressure may be increased in wellbore 34 causing burst disc 138 to fail. At this point, pressure will cause piston 112 to move against and break frangible element 130. Piston 112 may then move towards atmospheric chamber 120 thereby releasing sliding sleeve 83. Thus, it should be understood that on-demand hydrostatic/hydraulic trigger system 100 may be used to release any type of constrained element and thus could take the place of set screws, frangible links and the like.

Reference will now follow to FIG. 5, wherein like reference numbers represent corresponding parts in the respective views, in describing an on-demand hydrostatic/hydraulic trigger system 150 in accordance with another aspect of an exemplary embodiment. On-demand hydrostatic/hydraulic trigger system 150 selectively releases a piston or tool 155 shown as having a solid cross-section arranged in component 70. Tool 155 may be used to shift, for example, another component, or, in the alternative, open or close a flow path. Tool 155 may be arranged along passage 77 or, alternatively, in a housing (not shown) arranged between outer surface 72 and inner surface 74. It should be understood that tool 155 may take on various forms and could include a hollow cross-section.

On-demand hydrostatic/hydraulic trigger system 150 includes a piston 156 arranged in piston cylinder 104. Piston 156 includes a first piston portion 158 and a second piston portion 160 that acts as a constraining element that prevents movement of tool 155. First piston portion 158 includes a first diameter (not separately labeled) that corresponds to the first diameter of first cylinder portion 106 and second piston portion 160 includes a second diameter (also not separately labeled) that corresponds to the second diameter of second cylinder portion 108. A plug or cap 163 is arranged in piston cylinder 104 trapping an amount of air radially outwardly of piston 156 forming an atmospheric chamber 166.

A chamber 170 is arranged between first cylinder portion 106 and second cylinder portion 108. Chamber 170 may be defined by a recess (not separately labeled) formed in an inner surface of cap 163. A frangible element 172 rests in the recess and extends into piston 156. Frangible element 172 selectively locks piston 156 in piston cylinder 104. Frangible element 172 may fail, e.g., break, fracture, or the like) when exposed to shear and/or tensile forces. In the embodiment shown, a trigger passage 180 extends through cap 163. A burst disc 184 my selectively fluidically isolate trigger passage 180 from, for example, wellbore 34. It should be understood, that on-demand hydrostatic/hydraulic trigger system 150 may also function without burst disc 184.

In operation, fluid pressure may be raised in wellbore 34 causing burst disc 184 to fracture. Fluid may pass through passage 180 and flow into chamber 170. Pressure in chamber 170 acts against piston 156 causing frangible element 172 to fail allowing piston 156 to shift into piston cylinder 104 such that second piston portion 160 releases tool 155. Alternatively, fluid pressure may be introduced into tubular string 30. The pressure may build against tool 155 and act upon second piston portion 160. At a selected pressure, piston 156 shifts radially outwardly breaking frangible element 172 to release tool 155.

Figure 6:
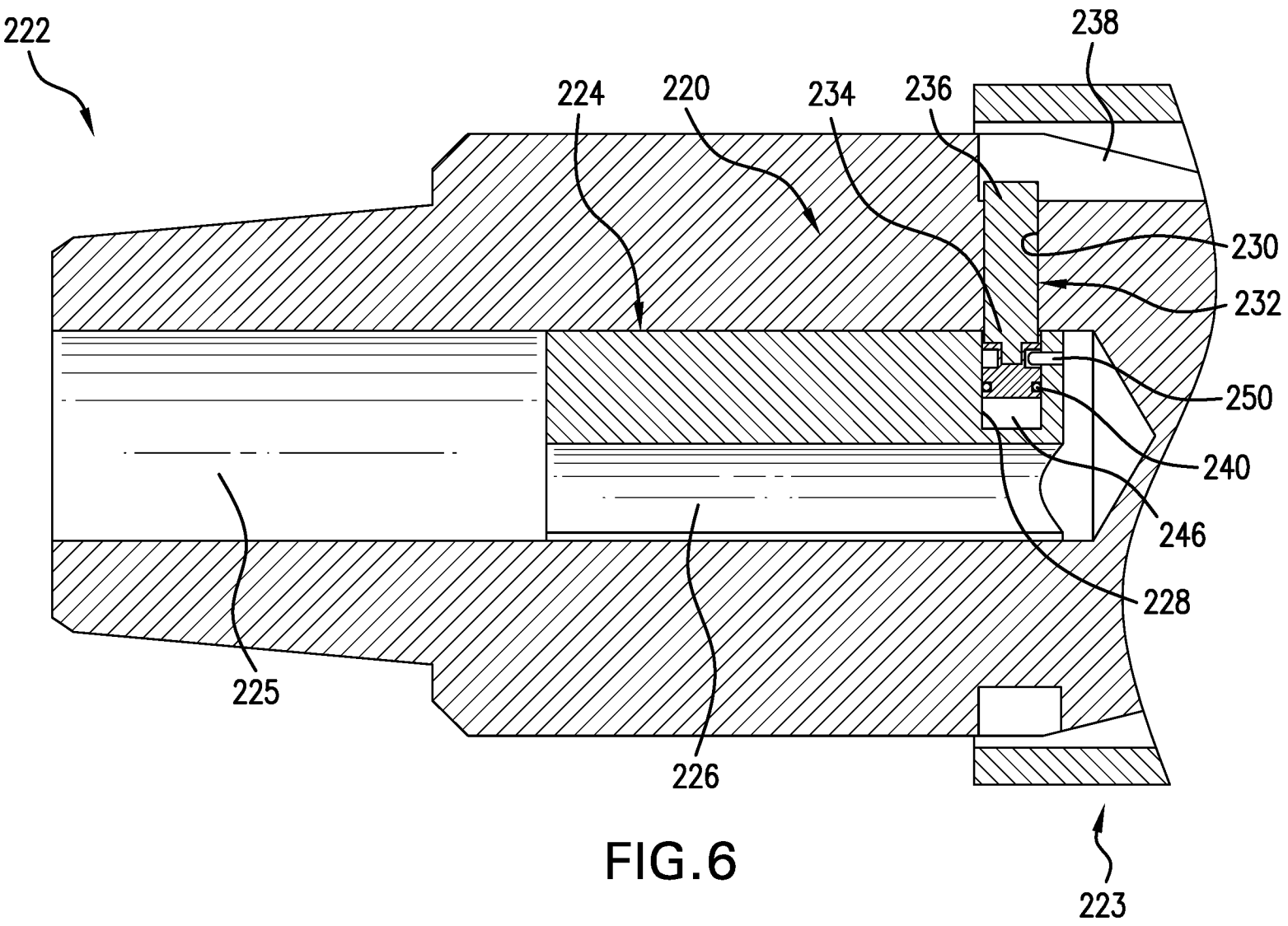
FIG. 6 depicts a glass view of the window mill joined to a whipstock connector through a connection system, in accordance with yet another exemplary aspect.
Figure 7:
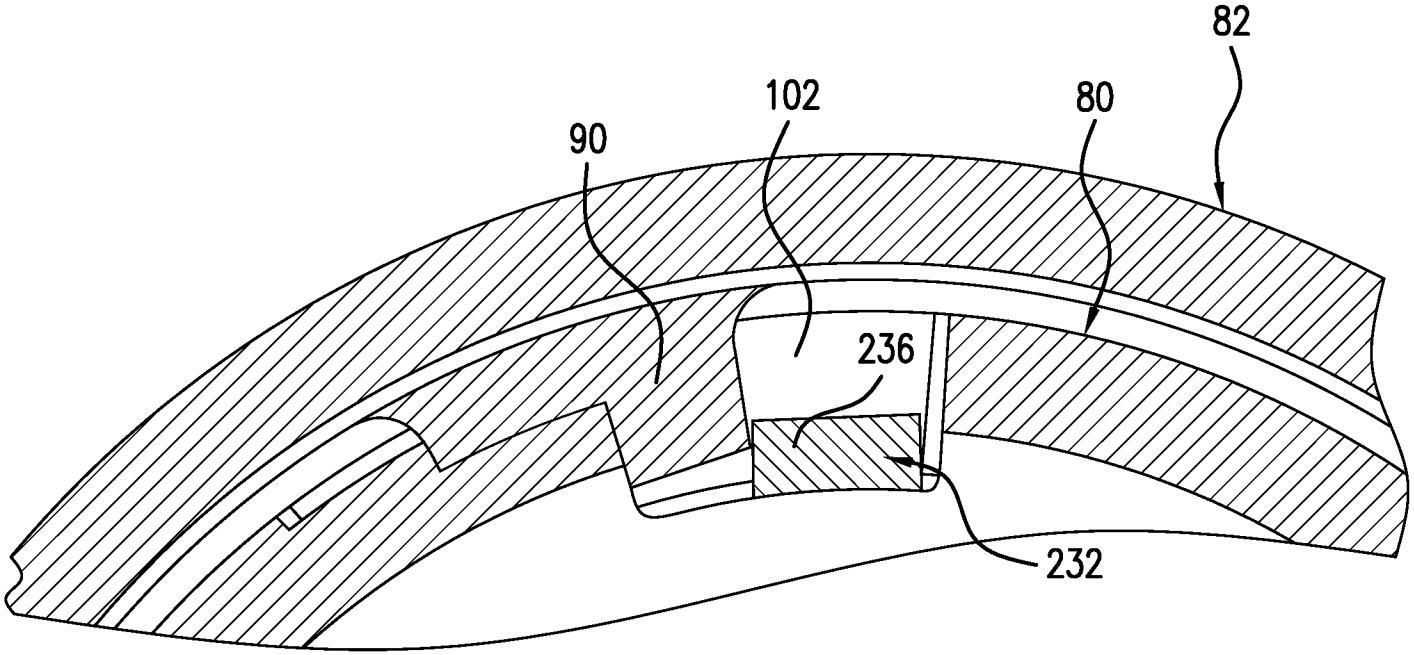
FIG. 7 depicts an axial end view of the connection system of FIG. 6 joining the window mill to the whipstock connector, in accordance with an exemplary aspect.

Reference will now follow to FIGS. 6 and 7, in describing a connection system 220 in accordance with still yet another aspect of an exemplary embodiment. Connection system 220 is employed to join a constrained element, shown in the form of a window mill 222 to a whipstock connector 223. Connection system 220 includes an insert 224 that is arranged in an axial passage 225 formed in window mill 222. Insert 224 includes a central axial passage 226 that registers with axial passage 225 as well as one or more pin pockets 228 that extend radially outwardly and register with one or more radial passages 230 that extend through window mill 222.

A pin 232, which acts as a constraining element, is arranged in pin pocket 228. Pin 232 includes a first end 234 and a second end 236. First end 234 resides in pin pocket 228 while second end 236 selectively extends into a recess 238 formed in window mill 222. A seal 240 is arranged on first end 234. Seal 234 forms an atmospheric chamber 246 in pin pocket 228. A frangible link 250 may releasably lock seal 240 in pin pocket 228. At this point, it should be understood that the number of pin pockets and pins may vary. For example, pin pockets and pins may extend entirely annularly about insert 224.

In a manner also similar to that discussed above, window mill 222 may be joined to whipstock connector 223 by extending pin(s) 232 into recesses 238. Window mill 222 and whipstock connector 223 may be positioned in wellbore 34 and held in place by a rotary table (not shown). Window mill 222 and whipstock connector 223 are deployed to a selected depth in wellbore 34 to form a casing window.

When it is desired to disconnect window mill 222, a pressurized fluid may be passed into wellbore 34. The pressurized fluid acts on each pin 236 resulting in breaking frangible fasteners 250 and movement of pins 236 into atmospheric chambers 246. At this point, window mill 222 may be rotated and thereby be release from whipstock connector 223. While described as being employed to disconnect a window mill from a whipstock connector, it should be understood that the use of an atmospheric chamber and constraining elements such as pins could be employed in various systems to allow components to be disconnected from one another.

Figure 8:
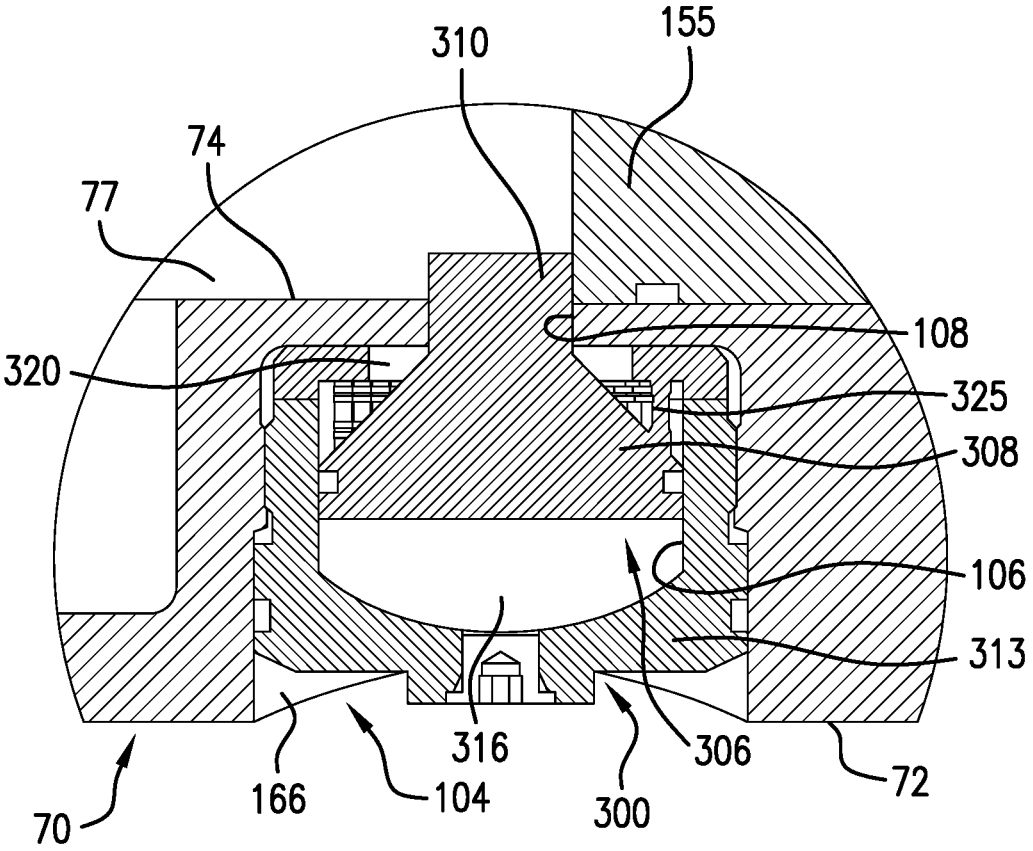
FIG. 8 depicts an on demand hydrostatic/hydraulic trigger system, in accordance with yet another aspect of an exemplary embodiment.

FIG. 8, wherein like reference numbers represent corresponding parts in the respective views, depicts an on-demand hydrostatic/hydraulic trigger system 300 in accordance with another aspect of an exemplary embodiment. On-demand hydrostatic/hydraulic trigger system 300 selectively releases piston or tool 155 arranged in component 70. Tool 155 may be used to shift, for example, another component, or, in the alternative, open or close a flow path. Tool 155 may be arranged along passage 77 or, alternatively, in a housing (not shown) arranged between outer surface 72 and inner surface 74.

On-demand hydrostatic/hydraulic trigger system 300 includes a piston 306 arranged in piston cylinder 104. Piston 306 includes a first piston portion 308 and a second piston portion 310. Second piston portion 310 acts as a constraining element which prevents movement of tool 155. First piston portion 308 includes a first diameter (not separately labeled) that corresponds to the first diameter of first cylinder portion 106 and second piston portion 310 includes a second diameter (also not separately labeled) that corresponds to the second diameter of second cylinder portion 108. A plug or cap 313 is arranged in piston cylinder 104 trapping an amount of air radially outwardly of piston 306 forming an atmospheric chamber 316.

A chamber 320 is arranged between first cylinder portion 106 and second cylinder portion 108. Chamber 320 may exist in first cylinder portion 106 between first piston portion 308 and second piston portion 310. Piston 306 includes a frangible element 325 that projects from first piston portion 308 and is disposed between cap 313 and an inner surface (not separately labeled) of piston cylinder 104. Frangible element 325 may be integrally formed with piston 306 through a variety of techniques including molding, machining, additive manufacturing and the like. Frangible element 325 selectively locks piston 306 in piston cylinder 104. Frangible element 172 may fail, e.g., break, fracture, or the like) when exposed to, for example, tensile forces in a manner similar to that described herein. Upon failure of frangible element 325, tool 155 may be unconstrained and allowed to shift.

At this point, it should be understood that the exemplary embodiments describe an on-demand hydrostatic/hydraulic trigger that is configured to release a sliding component in a tubular. In contrast to prior art systems in which the trigger applies pressure to the sliding component, the present invention shifts out of the way of the sliding component. In this manner, the on-demand hydrostatic/hydraulic trigger would not over pressure the sliding component. Further, the on-demand hydrostatic/hydraulic trigger may be readily installed into a tubular. That is, the on-demand hydrostatic/hydraulic trigger may be installed off-site and or on-site without the need for special tools.

Set forth below are some embodiments of the foregoing disclosure:

Embodiment 1. A downhole component comprising: a member including an outer surface; a constrained element configured to move relative to the member between a first position and a second position; and an on-demand hydrostatic/hydraulic trigger system including a constraining element operable to selectively release the constrained element, wherein the on-demand hydrostatic/hydraulic trigger system includes a piston cylinder.

Embodiment 2. The downhole component according to any prior embodiment, wherein the on-demand hydrostatic/hydraulic trigger system includes a piston arranged in the piston cylinder, the piston including a first piston portion extending into the piston cylinder and a second piston portion defining the constraining element that selectively prevents movement of the constrained element.

Embodiment 3. The downhole component according to any prior embodiment, wherein the on-demand hydrostatic/hydraulic trigger system includes a cap arranged in the piston cylinder radially outwardly of and spaced from the piston by a gap, the gap defining an atmospheric chamber in the downhole component.

Embodiment 4. The downhole component according to any prior embodiment, wherein the on-demand hydrostatic/hydraulic trigger system includes a trigger passage extending through the outer surface into the piston cylinder.

Embodiment 5. The downhole component according to any prior embodiment, wherein the on-demand hydrostatic/hydraulic trigger system includes a burst disc arranged in the trigger passage, the burst disc selectively fluidically isolating the piston cylinder from pressure external to the member.

Embodiment 6. The downhole component according to any prior embodiment, wherein the trigger passage extends through the cap.

Embodiment 7. The downhole component according to any prior embodiment, wherein the on-demand hydrostatic/hydraulic trigger system includes a burst disc arranged in the trigger passage.

Embodiment 8. The downhole component according to any prior embodiment, wherein the on-demand hydrostatic/hydraulic trigger system includes a channel extending through the outer surface into the piston cylinder and a frangible element arranged in the channel, the frangible element abutting the piston.

Embodiment 9. The downhole component according to any prior embodiment, wherein the on-demand hydrostatic/hydraulic trigger system includes a chamber arranged in the piston cylinder at the second piston portion.

Embodiment 10. The downhole component according to any prior embodiment, wherein the cap includes a recess that defines the chamber.

Embodiment 11. The downhole component according to any prior embodiment, wherein the on-demand hydrostatic/hydraulic trigger system includes a frangible element extending from the recess into the piston.

Embodiment 12. The downhole component according to any prior embodiment, wherein the on-demand hydrostatic/hydraulic trigger system includes a gap radially inward of the first piston portion, the gap defining an atmospheric chamber in the downhole component.

Embodiment 13. The downhole component according to any prior embodiment, wherein on-demand hydrostatic/hydraulic trigger system includes a frangible element holding the piston in place.

Embodiment 14. A method of selectively releasing a constrained member in a subterranean component disposed in a wellbore comprising: directing fluid pressure onto a constraining element arranged in a cylinder formed in the subterranean component; shifting the constraining element away from the constrained member; and shifting the constrained member from a first position to a second position.

Embodiment 15. The method according to any prior embodiment, wherein introducing the fluid pressure includes increasing annular pressure by passing a fluid between an annular wall of the wellbore and a tubular extending into the wellbore.

Embodiment 16. The method according to any prior embodiment, further comprising: passing the fluid through a trigger passage fluidically connected to the cylinder.

Embodiment 17. The method according to any prior embodiment, further comprising: breaking a burst disc arranged in the trigger passage.

Embodiment 18. The method according to any prior embodiment, shifting the constraining element away from the constrained member includes breaking a frangible element.

Embodiment 19. The method according to any prior embodiment, wherein breaking the frangible element includes exposing the frangible element to one of a shear force and a tensile force.

Embodiment 20. The method according to any prior embodiment, wherein introducing the fluid pressure into the wellbore includes directing fluid into a tubular extending into the wellbore and fluidically connected to the subterranean component.

Embodiment 21. The method according to any prior embodiment, wherein shifting the constrained member includes shifting a sliding sleeve disposed in the subterranean component.

Embodiment 22. The method according to any prior embodiment, wherein shifting the constrained member includes shifting a piston arranged in the subterranean component.

Embodiment 23. The method according to any prior embodiment, wherein the constraining element moves towards an atmospheric chamber.

Embodiment 24. The method according to any prior embodiment, wherein, if increasing annular pressure does not move constraining member, tubing pressure is in increased to move constraining member.

Embodiment 25. The method according to any prior embodiment, wherein, increasing the fluid pressure includes increasing tubing pressure.

Embodiment 26. The method according to any prior embodiment, wherein, if increasing tubing pressure does not move constraining member, pressure between an annular wall of the wellbore and a tubular extending into the wellbore is increased to move the constraining member.

Embodiment 27. The method according to any prior embodiment, wherein shifting the constrained member includes allowing the constrained member to rotate.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole component comprising:

a member including an outer surface;

a constrained element configured to move relative to the member between a first position and a second position; and an on-demand hydrostatic/hydraulic trigger system including a piston cylinder;

a constraining element operable to selectively release the constrained element, the constraining element including a piston arranged in the piston cylinder;

a trigger passage extending through the outer surface of the member into the piston cylinder; and a cap arranged in the piston cylinder radially outwardly of and spaced from the piston by a gap, the trigger passage extending along the cap, the gap defining an atmospheric chamber in the downhole component.

2. The downhole component according to claim 1, wherein the piston includes a first piston portion extending into the piston cylinder and a second piston portion defining the constraining element that selectively prevents movement of the constrained element.

3. The downhole component according to claim 2, wherein the on-demand hydrostatic/hydraulic trigger system includes another chamber arranged in the piston cylinder at the second piston portion.

4. The downhole component according to claim 3, wherein the cap includes a recess that defines the another chamber.

5. The downhole component according to claim 4, wherein the on-demand hydrostatic/hydraulic trigger system includes a frangible element extending from the recess into the piston.

6. The downhole component according to claim 1, wherein the trigger passage extends through the cap.

7. The downhole component according to claim 1, wherein the on-demand hydrostatic/hydraulic trigger system includes a channel extending through the outer surface into the piston cylinder and a frangible element arranged in the channel, the frangible element abutting the piston.

8. The downhole component according to claim 1, wherein the trigger passage extends through the cap.

9. The downhole component according to claim 8, further comprising: a burst disc arranged in the trigger passage, the burst disc selectively fluidically isolating the piston cylinder from pressure external to the member.

10. The downhole component according to claim 9, wherein the bust disc is arranged in the cap.

* * * * *